US010214039B2

(12) United States Patent
Sodeyama

(10) Patent No.: US 10,214,039 B2
(45) Date of Patent: Feb. 26, 2019

(54) TAPE CARTRIDGE

(71) Applicant: Seiko Epson Corporation, Tokyo (JP)

(72) Inventor: Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 415 days.

(21) Appl. No.: 15/002,651

(22) Filed: Jan. 21, 2016

(65) Prior Publication Data

US 2016/0136984 A1 May 19, 2016

Related U.S. Application Data

(63) Continuation of application No. 13/881,143, filed as application No. PCT/JP2011/006014 on Oct. 27, 2011, now Pat. No. 9,272,555.

(30) Foreign Application Priority Data

Nov. 11, 2010 (JP) ..... 2010-253102

(51) Int. Cl.
*B41J 15/04* (2006.01)
*B41J 32/00* (2006.01)
*B41J 33/52* (2006.01)

(52) U.S. Cl.
CPC ..... *B41J 32/00* (2013.01); *B41J 15/04* (2013.01); *B41J 15/044* (2013.01); *B41J 33/52* (2013.01)

(58) Field of Classification Search
CPC . B41J 32/00; B41J 15/04; B41J 15/044; B41J 33/52; B65H 23/00; B65H 23/04; B65H 23/06; B65H 2403/72; B65H 2701/00; B65H 2701/30; B65H 2701/37; B65H 2701/378
See application file for complete search history.

(56) References Cited

U.S. PATENT DOCUMENTS 5,918,992 A 7/1999 Matsuhashi et al.
6,042,039 A 3/2000 Furuya et al.
9,272,555 B2 * 3/2016 Sodeyama ..... B41J 15/044

FOREIGN PATENT DOCUMENTS

EP 0696510 A1 2/1996
JP 09-272250 A 10/1997

* cited by examiner

*Primary Examiner* — William A. Rivera
(74) *Attorney, Agent, or Firm* — Workman Nydegger

(57) ABSTRACT

A tape reel device includes a cartridge case (20) rotatably accommodating a spool (22*b*) around which an ink ribbon (22*a*) is wound, and a brake (3) for providing back tension to the ink ribbon (22*a*) unwound from the spool (22*b*). The brake (3) includes a sliding contact member (35) in sliding contact with end surface of the rotating spool (22*b*), a coil spring (36) urging the sliding contact member (35) in shaft direction of the spool (22*b*), and a rotation restrictor (37) for restricting rotation of the sliding contact member (35). The rotation restrictor (37) includes an engaging portion protruded from the cartridge case (20) to be inserted into the sliding contact member (35), and a to-be-engaged portion (44) which is protruded from inner circumference of the sliding contact member (35) and with which the engaging portion engages in rotation direction of the spool (22*b*).

6 Claims, 6 Drawing Sheets

[Fig. 1]
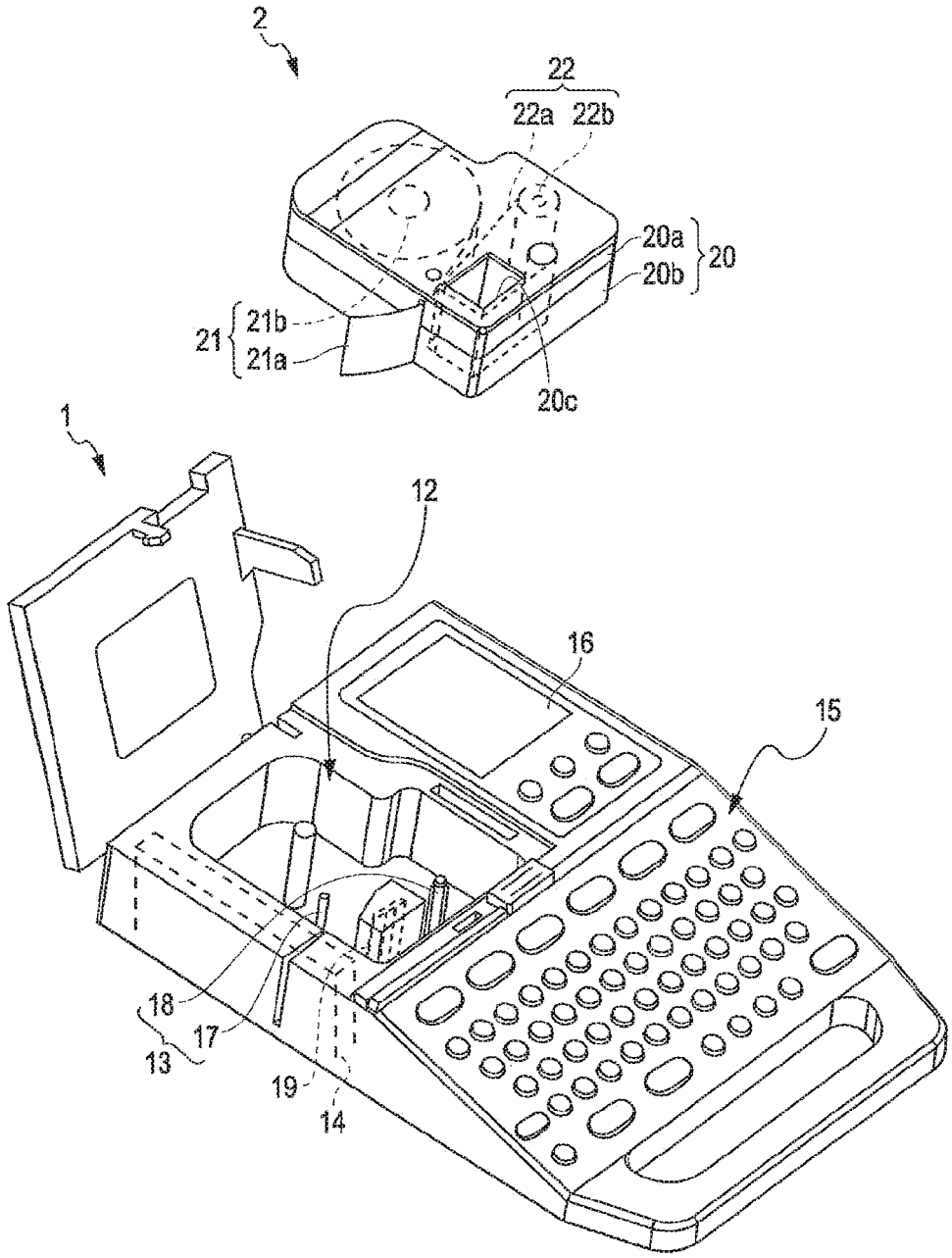

[Fig. 2]
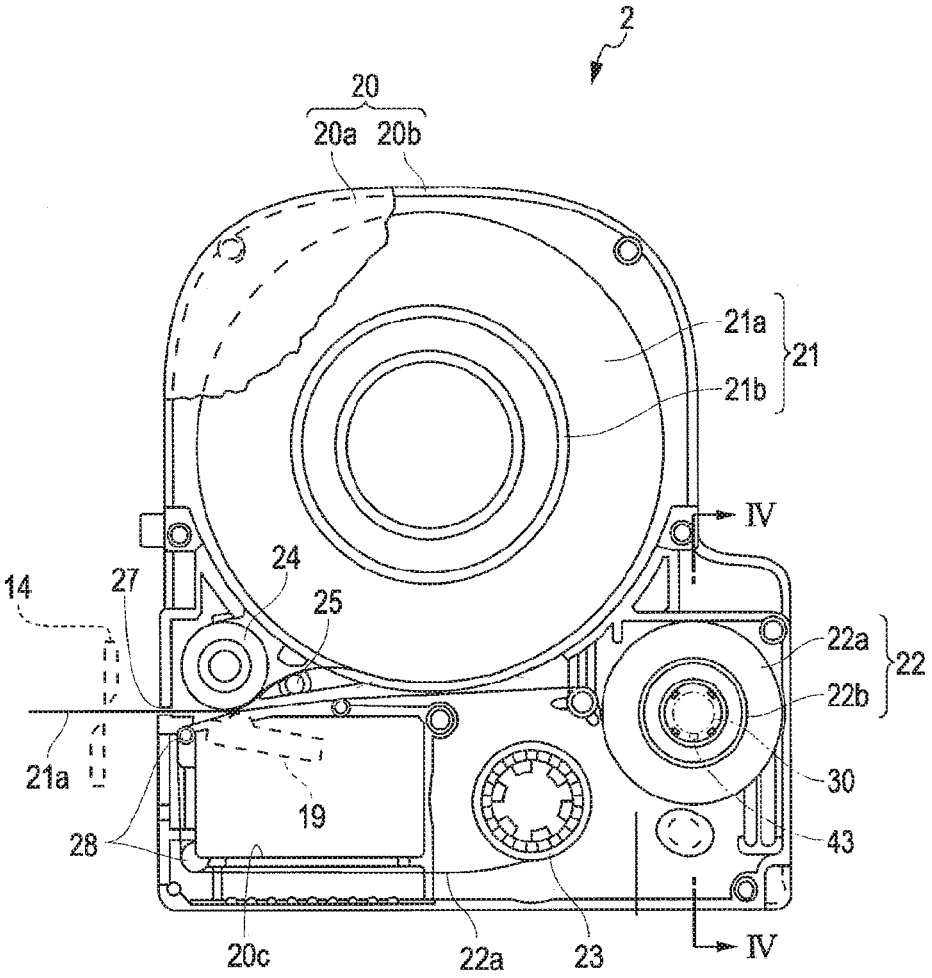

[Fig. 3]
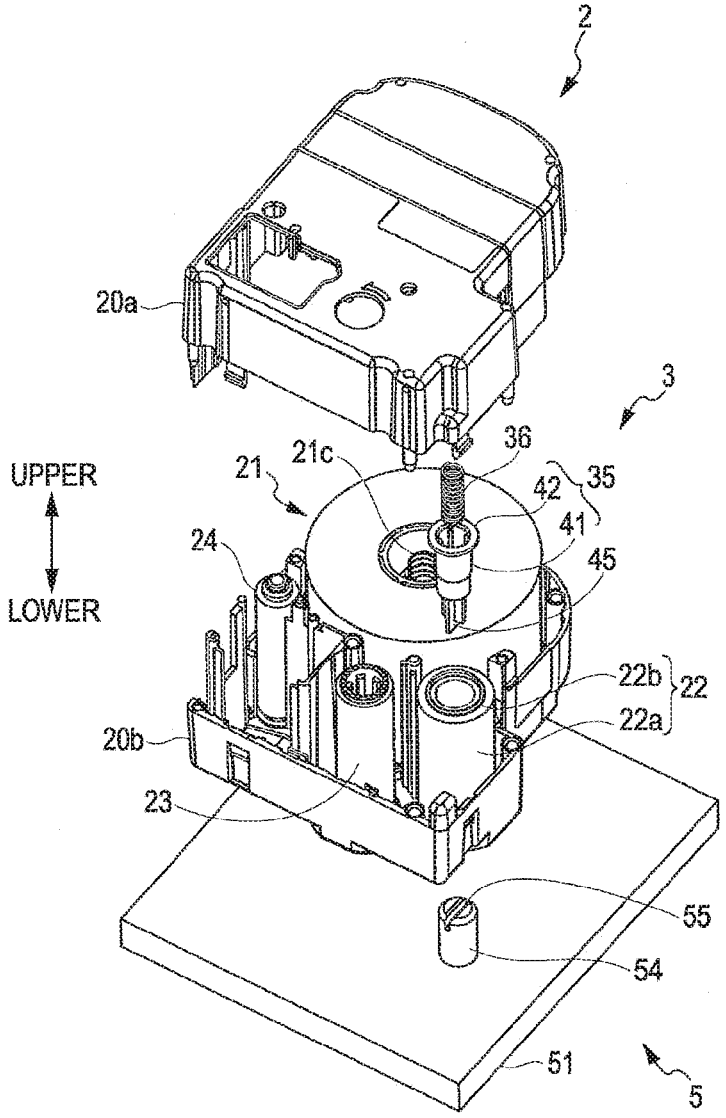

[Fig. 4A]
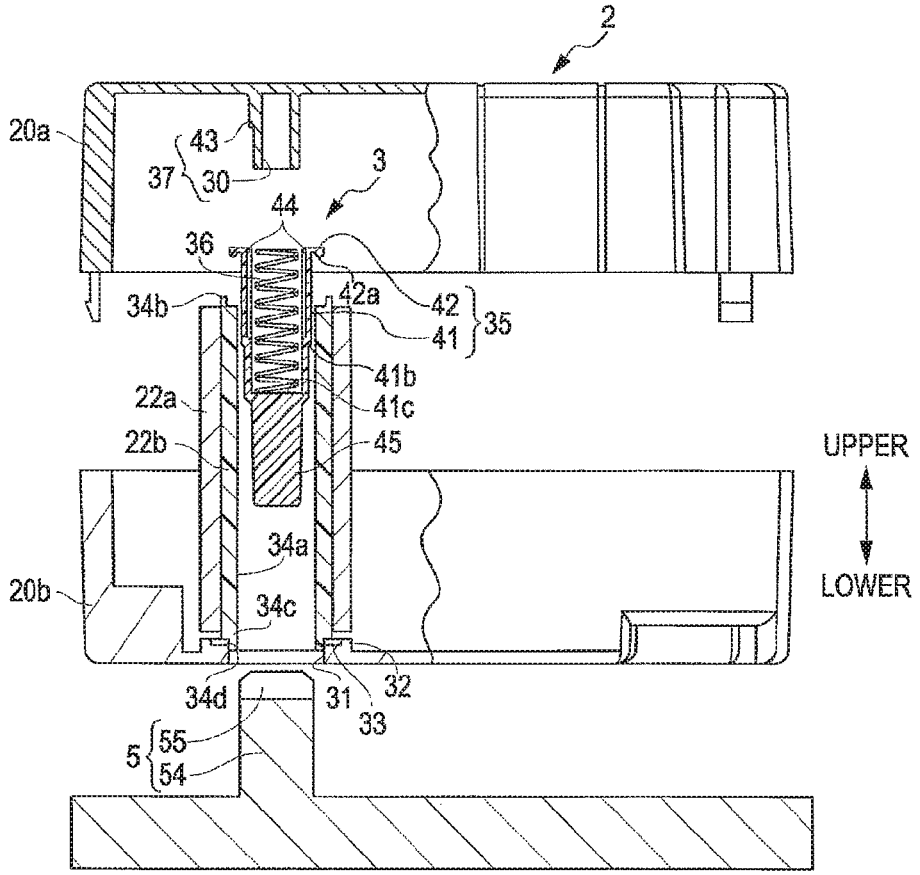
[Fig. 4B]
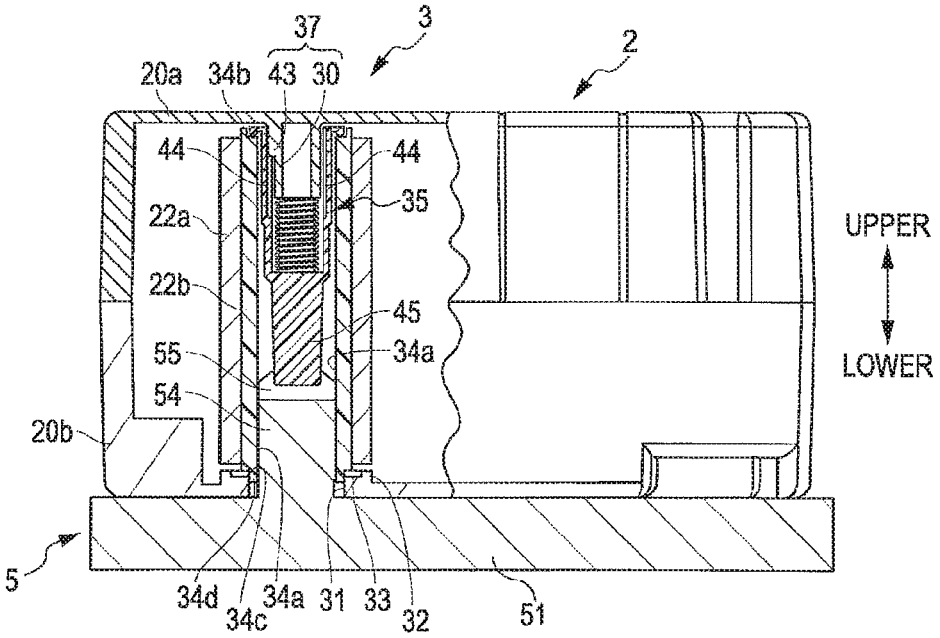

[Fig. 5A]
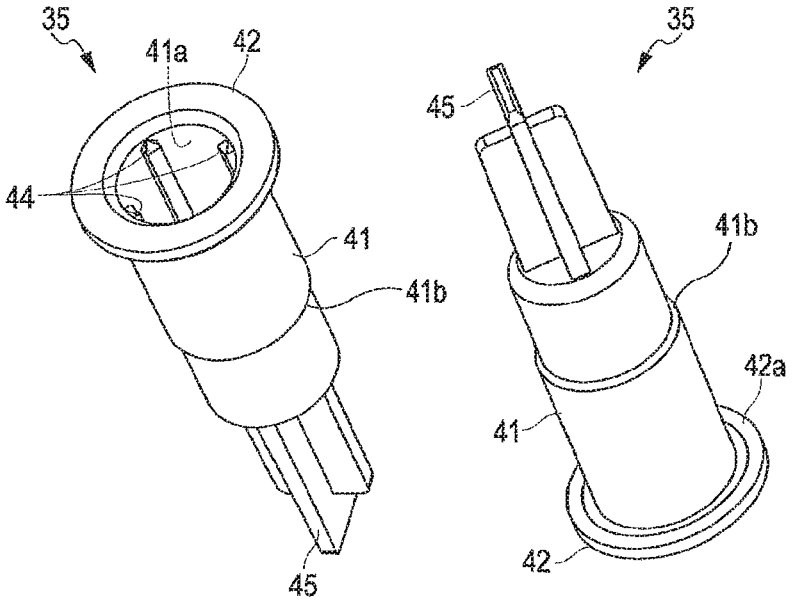
[Fig. 5B]
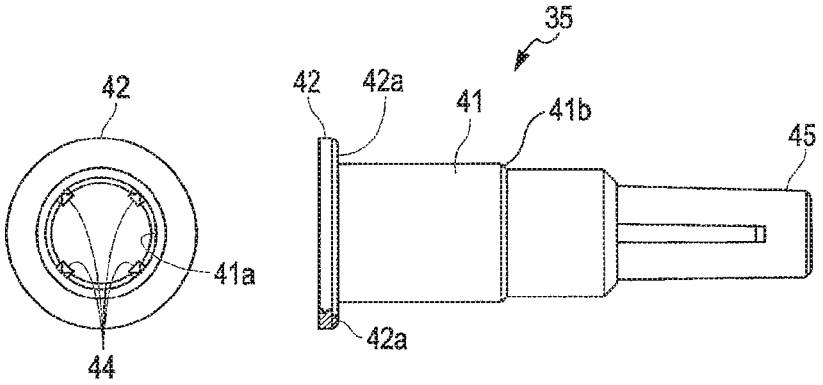

[Fig. 6]
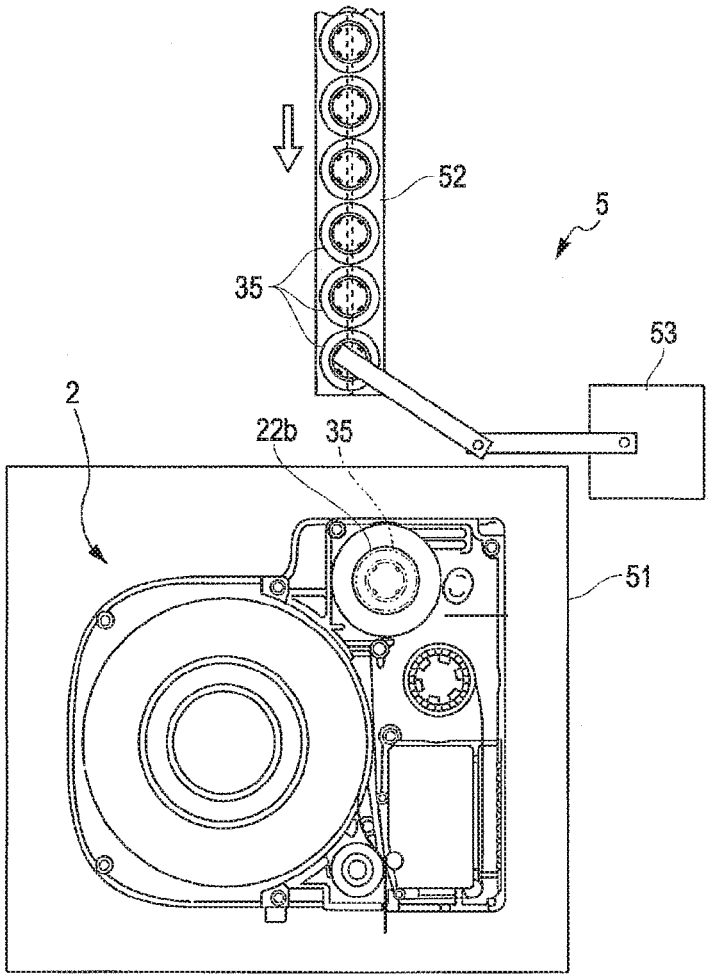

TAPE CARTRIDGE

CROSS REFERENCE TO RELATED APPLICATIONS

This application is a continuation of, and claims priority under 35 U.S.C. § 120 on, application Ser. No. 13/881,143, filed Apr. 23, 2013, which is a U.S. national phase application of PCT/JP2011/006014, filed Oct. 27, 2011, which claims priority under 35 U.S.C. § 119 on Japanese Patent Application No. 2010-253102, filed Nov. 11, 2010. The content of each such related application is incorporated by reference herein in its entirety.

BACKGROUND OF THE INVENTION

Technical Field

The present invention relates to a tape reel device for feeding a tape-shaped member wound around an outer circumference of a spool rotatably accommodated in a case while providing back tension to the tape-shaped member, and a tape cartridge provided with the tape reel device.

Background Art

Conventionally, a tape reel device including a spool which is pivotally supported by an upper case and a lower case and around which an ink ribbon is wound and a braking means which is inserted into a hollow portion of the spool from an upper end of the spool is known (see PTL 1). The braking means urges downward a sliding contact member which includes a flange portion at the upper end thereof and which is formed in a cylindrical shape having a bottom by using a coil spring accommodated inside the inner circumference thereof, so that the braking means puts a brake on rotation of the spool by pressing the sliding contact member onto the spool. A tongue-shaped piece extended downward from the upper case engages with a to-be-engaged portion provided at an eccentric position on the bottom portion of the sliding contact member to prevent the sliding contact member from rotating along with the spool. In this way, back tension is provided to a fed ink ribbon.

CITATION LIST

Patent Literature

[PTL 1]
JP-A-9-272250

Technical Problem

In a conventional tape reel device, to restrict rotation of a sliding contact member, a tongue-shaped piece (engaging portion) extended from an upper case is engaged with an to-be-engaged portion provided inside a coil spring on a bottom portion of the sliding contact member. In this case, the tongue-shaped piece needs to be formed thin and long so that the tongue-shaped piece can be inserted into the bottom of the sliding contact member, so a large torsional moment is applied to the tongue-shaped piece. Therefore, there is a problem that the tongue-shaped piece is deformed and the sliding contact member rotates along with the spool depending on the strength of rotational force applied to the sliding contact member. In particular, the to-be-engaged portion is provided near the rotational center of the bottom portion of the sliding contact member, so that such a problem is noteworthy. Thus, it is not possible to provide a stable back tension to an ink ribbon (tape-shaped member).

SUMMARY OF THE INVENTION

Accordingly, it is an object of the present invention to provide a tape reel device in which the sliding contact member is reliably prevented from rotating along with the spool and a force applied to the engaging portion and the to-be-engaged portion can be small as much as possible, and a tape cartridge provided with the tape reel device.

A tape reel device of the present invention includes a spool which is formed in a cylindrical shape and in which a tape-shaped member is wound around an outer circumference of the spool, a case rotatably accommodating the spool, and a brake for providing back tension to the tape-shaped member unwound from the spool. The brake includes a sliding contact member which is formed in a cylindrical shape having a bottom and is in sliding contact with an end surface of the rotating spool, an urging member which is provided inside the sliding contact member and urges the sliding contact member in a shaft direction of the spool from the case, and a rotation restrictor for restricting rotation of the sliding contact member. The rotation restrictor includes an engaging portion protruded from the case to be inserted into the sliding contact member, and a to-be-engaged portion which is protruded from an inner circumference of the sliding contact member and with which the engaging portion engages in a rotation direction of the spool.

According to the configuration described above, the to-be-engaged portion is protruded from the inner circumference portion of the sliding contact member far apart from the rotation center, so that a force of torsion moment (moment of force around the rotation axis) applied to the engaging portion and the to-be-engaged portion can be small. Thereby, an engaging state between the engaging portion and the to-be-engaged portion can be reliably maintained, so that it is possible to prevent the sliding contact member from rotating along with the spool. In other words, a sliding state of the sliding contact member with respect to the spool is appropriately maintained and the sliding contact member can provide stable back tension to the unwound tape-shaped member. The engaging portion need not reach the bottom surface of the sliding contact member, so that the engaging portion can have a shape with sufficient strength. Therefore, it is preferred that the to-be-engaged portion is provided near the opening of the sliding contact member and the engage portion is not so much protruded from the case to have a shape difficult to be deformed.

In this case, it is preferred that the sliding contact member has a sliding portion in sliding contact with an end surface of the rotating spool and the sliding portion is formed in a cross-sectional half circle shape.

According to the above configuration, the contact between the end surface of the spool and the sliding portion of the sliding contact member is geometrically a single line contact (a line contact), so that it is possible to stably provide a desired load to the rotation of the spool when the tape-shaped member is unwound. Thereby it is possible to provide stable back tension to the tape-shaped member while allowing the spool to rotate.

In this case, it is preferred that a plurality of to-be-engaged portions are protruded from the inner circumference of the sliding contact member in a circumferential direction at regular intervals.

According to the above configuration, the engaging portion engages with one to-be-engaged portion among the plurality of to-be-engaged portions. Thereby, when the tape reel device is assembled, even if the engaging portion and the to-be-engaged portion do not engage with each other, the sliding contact member rotates along with the rotation of the spool, and a to-be-engaged portion nearest to the engaging portion in the rotation direction engages with the engaging portion. Thus, it is possible to shorten a rotation distance in which the sliding contact member rotates along with the rotation of the spool.

In this case, it is preferred that the urging member has a coil spring inserted into the sliding contact member, three or more to-be-engaged portions are protruded from the inner circumference of the sliding contact member, and the three or more to-be-engaged portions also function as positioning members of the coil spring in the sliding contact member.

According to the above configuration, it is possible to hold the coil spring at a desired position in the sliding contact member. Thereby, the coil spring can be accurately set in the sliding contact member (the coil spring is not obliquely set), so that assembling of the tape reel device can be smoothly performed.

In this case, it is preferred that a cylindrical urging-force-receiving portion protruding toward the sliding contact member is formed to be a reception portion of the coil spring inserted into the sliding contact member and the engaging portion is formed to be protruded to the outside in a radial direction at a base end portion of the urging-force-receiving portion.

According to the above configuration, the urging-force-receiving portion receives the coil spring and urges the sliding contact member to the spool, so that the sliding contact member is pressed to the spool and the rotation of the spool is braked by a predetermined force (stable frictional force). The engaging portion is formed to be supported by the case and the urging-force-receiving portion. Therefore, the engaging portion can be provided so that the engaging portion is structurally difficult to be deformed.

In this case, it is preferred that the coil spring is contained in the sliding contact member when the coil spring is accommodated in a free state.

According to the above configuration, when assembling the tape reel device, the urging-force-receiving portion can easily and reliably come into contact with the coil spring, and the engaging portion can easily and reliably engage with the to-be-engaged portion.

In this case, it is preferred that the case includes an upper case from which the engaging portion is protruded and a lower case in which the spool is set, an assembly fastens the upper case from above to the lower case in which the sliding contact member and the urging member are inserted into the spool to assemble the case, and the sliding contact member has a restriction piece which is extended from a lower end surface, engages with the assembly, and restricts a rotation position of the sliding contact member so that a position of the engaging portion of the upper case is shifted from positions of the to-be-engaged portions of the sliding contact member in a rotation direction.

According to the above configuration, the sliding contact member engages with the assembly at the restriction piece, so that the sliding contact member is unrotatably fixed to the spool via the assembly. The sliding contact member is fixed in a state in which the position of the engaging portion of the upper case is shifted in the rotation direction with respect to the positions of the to-be-engaged portions. Thereby, when the upper case is fastened to the lower case, it is possible to reliably prevent the engaging portion and the to-be-engaged portion from interfering with each other.

A tape cartridge of the present invention includes any one of the tape reel devices described above.

According to the configuration described above, it is possible to prevent the sliding contact member from rotating along with the spool, appropriately maintain the sliding contact state of the sliding contact member with respect to the spool, and feed the tape-shaped member while providing stable back tension to the fed tape-shaped member.

BRIEF DESCRIPTION OF DRAWINGS

FIG. 1 is an external perspective view of a tape printing device with a cover thereof opened.

FIG. 2 is a plan view of a tape cartridge with an upper case cut off.

FIG. 3 is an exploded perspective view of the tape cartridge and a perspective view of an assembly.

FIG. 4A is an exploded cross-sectional view of the assembly and the tape cartridge shown in FIG. 2 taken along line IV-IV.

FIG. 4B is a cross-sectional view of the assembly and the assembled tape cartridge shown in FIG. 2 taken along line IV-IV.

FIG. 5A is top and bottom perspective views of a sliding contact member.

FIG. 5B is a plan view and a side view of the sliding contact member.

FIG. 6 is a plan view showing the sliding contact member conveyed by a parts feeder.

DESCRIPTION OF EMBODIMENTS

Hereinafter, a tape cartridge to which a tape reel device according to an embodiment of the present invention is applied and a tape printing device in which the tape cartridge is mounted will be described. The tape printing device feeds a printing tape and an ink ribbon from the mounted tape cartridge, performs printing while feeding the printing tape and the ink ribbon side by side, and cuts off a printed portion of the printing tape to generate a label.

FIG. 1 is an external perspective view of a tape printing device 1 with a cover thereof opened. FIG. 2 is a plan view of a tape cartridge 2 with an upper case 20*a* cut off. The tape printing device 1 includes a cartridge mounting portion 12 in which a cartridge 2 accommodating a printing tape 21*a* and an ink ribbon 22*a* is attachably and detachably mounted, a tape feeder 13 for unwinding and feeding the printing tape 21*a* and the ink ribbon 22*a* while providing tension to the printing tape 21*a* and the ink ribbon 22*a*, and a cutter 14 for cutting the printed printing tape 21*a*. A user operates a keyboard 15 arranged on the upper surface of the tape printing device 1 and performs a printing operation while checking a display 16 on which an operation result and the like are displayed.

The tape feeder 13 includes a platen drive shaft 17 for rotating a platen roller 24, a reeling drive shaft 18 for rotating a reeling core 23, and a drive mechanism (not shown in the drawings) for synchronously rotating both drive shafts 17 and 18.

Next, the tape cartridge 2 will be described in detail. An outer shell of the tape cartridge 2 is formed by a cartridge case 20 including an upper case 20*a* and a lower case 20*b*. The cartridge case 20 rotatably accommodates a tape body 21 in which the printing tape 21*a* is wound around a tape core 21*b*, a ribbon body 22 in which the ink ribbon 22*a* is wound around a spool 22*b* (feeding core), a reeling core 23 for reeling the used ink ribbon 22*a*, and a platen roller 24 for unwinding and feeding the printing tape 21*a* and the ink ribbon 22*a* from the tape body 21 and the ribbon body 22 respectively. The upper case 20*a* and the lower case 20*b* are press-fitted and bonded by a pin and a through-hall formed on the bonding surfaces (the cases can be disassembled and reused).

A pass-through opening 20*c* which vertically passes through the cartridge case 20 is formed near the platen roller 24 in the cartridge case 20. When the cartridge 2 is mounted in the cartridge mounting portion 12, a thermal head 19 of the tape printing device 1 appears inside the pass-through opening 20*c*, comes into contact with the platen roller 24 with the printing tape 21*a* and the ink ribbon 22*a* in between, and enters a printing standby state (see FIG. 2). In this state, the platen drive shaft 17 engages with the platen roller 24, and the reeling drive shaft 18 engages with the reeling core 23. Specifically, the platen roller 24 and the reeling core 23 rotate in synchronization with each other, and the tape core 21*b* and the spool 22*b* are driven to be rotated.

When the printing is started, the ink ribbon 22*a* overlaps the printing tape 21*a* and runs together with the printing tape 21*a* at a portion of the platen roller 24. Printing processing is performed by the thermal head 19, and the printed printing tape 21*a* is sent to the outside through a tape ejection opening 27 formed on a side surface of the cartridge case 20 and a printed portion of the printing tape 21*a* is cut in the width direction of the tape by the cutter 14 to generate a tape piece (label). On the other hand, the ink ribbon 22*a* is guided by a plurality of ribbon path change pins 28 and the path is changed so that the ink ribbon 22*a* turns in a U shape in the pass-through opening 20*c*. Then, the ink ribbon 22*a* is reeled by the reeling core 23. The reeling core reels the ink ribbon 22*a* while rotating with slipping to provide tension to the ink ribbon 22*a*.

In the tape cartridge 2, when a series of printing processing is completed, the unwinding of the printing tape 21*a* and the ink ribbon 22*a* from the tape body 21 and the ribbon body 22 is stopped. In other words, the platen drive shaft 17 and the reeling drive shaft 18 repeats drive (rotation) and stop. In this case, if the tape core 21*b* and the spool 22*b*, which are driven to be rotated, are provided to rotate freely, the printing tape 21*a* and the ink ribbon 22*a* may be loosened and stuck inside the cartridge case 20. Or else, the front end of the printing tape 21*a* may be drawn into the cartridge case 20 through the tape ejection opening 27.

Therefore, on the inner circumference of the tape core 21*b*, a reverse rotation prevention mechanism including a ratchet groove (not shown in the drawings) and a reverse rotation prevention spring 21*c* (see FIG. 3) to be engaged with the ratchet groove is formed. The platen roller 24 is rotatably supported by elliptical shaft holes (not shown in the drawings) formed in the upper case 20*a* and the lower case 20*b*. When a force for drawing the printing tape 21*a* into the cartridge case 20 is applied, the platen roller 24 moves toward a tape guide pin 25, and the printing tape 21*a* is pinched between the tape guide pin 25 and the platen roller 24.

On the other hand, for the ink ribbon 22*a*, a brake 3 for providing back tension to the ink ribbon 22*a* is provided to the spool 22*b*. Hereinafter, a structure for providing the brake 3 will be described with reference to FIGS. 3 to 5. FIG. 3 is an exploded perspective view of the tape cartridge 2 and a perspective view of an assembly device 5. FIGS. 4A and 4B are cross-sectional views of the assembly device 5 and the tape cartridge 2 shown in FIG. 2 taken along line IV-IV. FIG. 4A is an exploded cross-sectional view and FIG. 4B is a cross-sectional view of the assembled tape cartridge. FIG. 5A is top and bottom perspective views of a sliding contact member 35. FIG. 5B is a plan view and a side view of the sliding contact member 35. In the description below, the upper and lower directions are defined as shown in FIGS. 3 and 4.

As shown in FIG. 4, in the upper case 20*a*, a cylinder-shaped cylindrical shaft portion 30 (referred to as "urging-force-receiving portion" in the claims) for pivotally supporting an upper end portion of the spool 22*b* via the sliding contact member 35 described below is protruded toward the inside of the cartridge case 20.

In the lower case 20*b*, a shaft hole 31 into which a lower end portion of the spool 22*b* is loosely inserted is opened, and a ring-shaped protrusion 32 for rotatably supporting the spool 22*b* is protruded toward the inside of the cartridge case 20 at the circumferential portion of the shaft hole 31. Although the drawing is omitted, a plurality of cut-out notches are formed at the lower end portion of the spool 22*b* along the circumferential direction, and a resilient hook piece formed integrally with the lower case 20*b* engages with the cut-out notch. The hook piece engages with the cut-out notch to prevent the spool 22*b* from rotating, so the hook piece prevents the ink ribbon 22*a* from being loosened at the time of transportation and storage. On the other hand, when the tape cartridge 2 is mounted in the cartridge mounting portion 12, the hook piece escapes from the cut-out notch, and the spool 22*b* becomes rotatable.

The spool 22*b* is formed in a cylindrical shape including a hollow portion 34*a* around the shaft center. A ring-shaped protrusion portion 34*b* is protruded from the upper end surface of the spool 22*b* so that the upper end surface of the ring-shaped protrusion portion 34*b* is substantially the same as that of the sliding contact member 35 (described below) inserted into the shaft center of the spool 22*b*. At the lower end portion of the spool 22*b*, a ring-shaped step portion 34*c* which seats on the ring-shaped protrusion 32 of the lower case 20*b* via a bearing ring 33 is formed, and a lower end shaft portion 34*d* extended downward from the ring-shaped step portion 34*c* is loosely inserted into the shaft hole 31 of the lower case 20*b*. In summary, the upper end portion of the spool 22*b* is rotatably supported by the upper case 20*a* via the brake 3 and the lower end portion is rotatably supported by the lower case 20*b* via the bearing ring 33. In this way, the spool 22*b* is pivotally supported at both ends, so that it is possible to secure stable rotation without shaking around the shaft center.

As shown in FIGS. 3 to 5, the brake 3 has the sliding contact member 35 formed in a cylindrical shape having a bottom, which is in sliding contact with an end surface of the rotating spool 22*b*, a coil spring 36 which is provided inside the sliding contact member 35 and urges the sliding contact member 35 downward in the spool 22*b* from the upper case 20*a*, and a rotation restrictor 37 for restricting the rotation of the sliding contact member 35. The brake 3 lies between the upper case 20*a* and the spool 22*b*, and puts a brake on the rotation of the spool 22*b* caused by unwinding the ink ribbon 22*a*. The spool 22*b* and the sliding contact member 35 are respectively formed of different types of abrasion-resistant resins (ABS, PP, or the like), and it is considered so that the spool 22*b* and the sliding contact member 35 slide stably and unnecessary abrasion is not generated between the spool 22*b* and the sliding contact member 35.

The sliding contact member 35 has a spring accommodation portion 41 which is formed in a cylindrical shape having a bottom and accommodates the coil spring 36, and a circular flange portion 42 which is provided on the upper end portion of the spring accommodation portion 41 and in sliding contact with the upper end portion of the spool 22*b*. The sliding contact member 35 is provided in the hollow portion 34*a* of the spool 22*b*. The sliding contact member 35 is coaxially provided with the spool 22*b*.

The flange portion 42 has a sliding portion 42*a* being in contact with the upper end surface of the spool 22*b* from above. The sliding portion 42*a* protrudes from the lower surface of the flange portion 42. The sliding portion 42*a* has a ring-shape and a half-circle-shaped cross-section (see FIGS. 4A, 4B, and 5B). When the spool 22*b* rotates, the sliding portion 42*a* slides on the upper end surface of the spool 22*b* in line contact with the upper end surface. The flange portion 42 is arranged inside the ring-shaped protrusion portion 34*b* of the spool 22*b* with a slight clearance in between, and the top end portion of the spool 22*b* is pivotally and rotatably supported by the flange portion 42 and the cylindrical shaft portion 30 of the upper case 20*a*.

The spring accommodation portion 41 accommodates the coil spring 36 as well as includes an inner circumference portion 41*a* with which the cylindrical shaft portion 30 vertically arranged on the upper case 20*a* engages. The spring accommodation portion 41 has a stepped cylindrical shape including a step portion 41*b* on its outer surface, and substantially the lower half of the spring accommodation portion 41 is formed thinner the upper half. Thereby, the front end circumference of the spring accommodation portion 41 is reliably prevented from coming into contact with the inner circumference of the hollow portion 34*a* of the spool 22*b*, so the braking operation of the flange portion 42 to the spool 22*b* is not affected (stable braking torque is ensured).

The coil spring 36 is arranged to urge a bottom wall 41*c* of the spring accommodation portion 41 downward from the lower end surface of the cylindrical shaft portion 30. In other words, the coil spring 36 presses the flange portion 42 to the upper end surface of the spool 22*b* via the spring accommodation portion 41 (see FIG. 4B). In this case, as described above, the flange portion 42 is in line contact with the spool 22*b* at the sliding portion 42*a* which is the lower surface of the flange portion 42, and the coil spring 36 accommodated in the spring accommodation portion 41 is arranged coaxially with the spool 22*b*, so that the flange portion 42 is pressed to the rotating spool 22*b* with uniform force and the sliding is stable. Thereby, a stable load can be applied to the spool 22*b*, so that it is possible to provide stable back tension to the ink ribbon 22*a* while allowing the spool 22*b* to rotate. The coil spring 36 is formed in a size so that the coil spring 36 does not protrude from the upper end of the spring accommodation portion 41 when the coil spring 36 is accommodated in the spring accommodation portion 41 in a free state (see FIG. 4A).

The rotation restrictor 37 includes an engaging portion 43 protruded from the upper case 20*a* so that the engaging portion 43 is inserted into the spring accommodation portion 41 and four to-be-engaged portions 44 which is protruded from the side surface of the inner circumference portion 41*a* of the spring accommodation portion 41 and with which the engaging portion 43 engages in the rotation direction of the spool 22*b*.

The engaging portion 43 is formed to be protruded to the outside in the radial direction at the base end portion of the cylindrical shaft portion 30. Specifically, the engaging portion 43 is a block-shaped protrusion formed integrally with the lower surface of the upper case 20*a* and the cylindrical shaft portion 30. It is preferred that the engaging portion 43 is not so much protruded from the lower surface of the upper case 20*a* and has a shape difficult to be deformed. In this case, the to-be-engaged portions 44 are provided near the upper opening of the spring accommodation portion 41, and the engaging portion 43, which protrudes not so much, engages with the to-be-engaged portion 44.

On the other hand, the four to-be-engaged portions 44 are inwardly protruded from the inner circumference portion 41*a* at regular intervals (at 90 degrees intervals) in the circumferential direction of the inner circumference portion 41*a*, and vertically extended from the upper end of the spring accommodation portion 41 to the step portion 41*b*. The four to-be-engaged portions 44 also function as members for positioning the coil spring 36 in the spring accommodation portion 41. Thereby, the coil spring 36 can be accurately set in the sliding contact member 35 (the coil spring 36 is not obliquely set), so that assembling of the tape cartridge 2 can be smoothly performed.

The engaging portion 43 engages with one of the to-be-engaged portions 44 in the rotation direction of the spool 22*b* so as to prevent the sliding contact member 35 from rotating. In other words, the sliding contact member 35 is prevented from rotating along with the spool 22*b* by the engaging portion 43 and the to-be-engaged portions 44. Thereby, it is prevented that the sliding contact member 35 rotates and the coil spring 36 and the spring accommodation portion 41 rub against each other.

The to-be-engaged portions 44 are protruded from the inner circumference portion 41*a* far apart from the rotation center of the sliding contact member 35, so that a force of torsion moment (moment of force around the rotation axis) applied to the engaging portion 43 and the to-be-engaged portion 44 engaged with the engaging portion 43 can be small. Thereby, the engaging state between the engaging portion 43 and the to-be-engaged portion 44 can be reliably maintained, so that it is possible to prevent the sliding contact member 35 from rotating along with the spool 22*b*. In other words, the sliding state of the sliding contact member 35 with respect to the spool 22*b* is appropriately maintained and the sliding contact member 35 can provide stable back tension to the ink ribbon 22*a*.

The assembly of the tape cartridge 2 of the present embodiment is automated by an assembly device 5. Hereinafter, the assembly device 5 and the assembly procedure of the tape cartridge 2 using the assembly device 5 will be briefly described with reference to FIGS. 3, 4, and 6. FIG. 6 is a plan view showing the sliding contact member 35 conveyed by a parts feeder 52.

As shown in FIGS. 3 and 4, the assembly device 5 includes a table (not shown in the drawings) on which the tape cartridge 2 positioned on a pallet 51 is set, the parts feeder 52 for conveying the sliding contact member 35 and the like, and a pick-up mechanism 53 for transferring the sliding contact member 35 and the like from the parts feeder 52 to the tape cartridge 2. The pallet 51 is formed in a pressure-board-like shape and includes a positioning protrusion 54 for positioning and fixing the lower case 20*b* and the spool 22*b* on the upper surface thereof and a slit portion 55 cut into the front end portion of the positioning protrusion 54.

The positioning protrusion 54 is disposed upright on the pallet 51 and fits into the shaft hole 31 of the lower case 20*b* and the hollow portion 34*a* of the spool 22*b* from below. Thereby, the lower case 20*b* is positioned in a predetermined position on the pallet 51, and the spool 22*b* is supported upright in the lower case 20*b*.

When the sliding contact member 35 is inserted into the hollow portion 34*a* of the spool 22*b*, a restriction piece 45 which is formed integrally with the lower surface of the bottom wall 41*c* of the sliding contact member 35 and extended from the lower surface engages with the slit portion 55 (see FIG. 4B). The restriction piece 45 is formed in a plate shape. When the restriction piece 45 engages with the slit portion 55, the restriction piece 45 unrotatably supports the sliding contact member 35 in the spool 22*b*.

As shown in FIG. 6, the spool 22*b* (strictly speaking, ribbon body 22), the sliding contact member 35, and the coil spring 36 are transferred to near the lower case 20*b* set on the assembly device 5 by the parts feeder 52. Thereafter, the spool 22*b*, the sliding contact member 35, and the coil spring 36 are respectively picked up by the pick-up mechanism 53, and mounted in a predetermined position in the lower case 20*b* in order of the spool 22*b*, the sliding contact member 35, and the coil spring 36 (see FIGS. 3 and 4A). Finally, the upper case 20*a* is fastened to the lower case 20*b* from above, and thereby the tape cartridge 2 is assembled (see FIG. 4B). Although description is omitted, before the upper case 20*a* is fastened to the lower case 20*b*, components included in the tape cartridge 2, such as the tape body 21, the reeling core 23, and the platen roller 24 are mounted. The printing tape 21*a* and the ink ribbon 22*a* are unwound and fed into predetermined paths and the front end of the fed ink ribbon 22*a* is connected to the reeling core 23.

Here, the orientation of the restriction piece 45 of the sliding contact member 35 introduced in the parts feeder 52 is automatically aligned in a certain direction, and the sliding contact member 35 is transferred to a pick-up position. As described above, the restriction piece 45 is formed in a plate shape. Therefore, even when the sliding contact member 35 is rotated by 180 degrees from the certain direction (assumed to be 0 degrees) around the shaft direction, the sliding contact member 35 can be transferred. Therefore, the parts feeder 52 restricts the orientation of the sliding contact member 35 to be 0 degrees or 180 degrees. In this case, there is a risk that the to-be-engaged portion 44 and the engaging portion 43 interfere with each other and the upper case 20*a* cannot be fastened to the lower case 20*b* depending on the number and the position of the to-be-engaged portions 44 in the spring accommodation portion 41.

However, in the sliding contact member 35 according to the present embodiment, four to-be-engaged portions 44 are provided at regular intervals in the circumferential direction. Therefore, if the orientation of the sliding contact member 35 is in a direction (0 degrees or 180 degrees) in which the sliding contact member 35 can be transferred by the parts feeder 52, the positions of the to-be-engaged portions 44 in the spring accommodation portion 41 do not change, so that it is possible to provide the to-be-engaged portions 44 at positions where the engaging portion 43 of the upper case 20*a* does not interfere with the to-be-engaged portions 44. In other words, the sliding contact member 35 is positioned in a state in which the position of the engaging portion 43 of the upper case 20*a* is shifted in the rotation direction with respect to the positions of the to-be-engaged portions 44 which engage with the slit portion 55. Specifically, the to-be-engaged portions 44 and the restriction piece 45 in the sliding contact member 35 are provided so that the positions of the to-be-engaged portions 44 are shifted from the position of the engaging portion 43 by 45 degrees (see two-dot chain line in FIG. 2).

Thereby, when the cylindrical shaft portion 30 is mounted in the sliding contact member 35 inserted into the spool 22*b* along with the upper case 20*a*, the to-be-engaged portions 44 and the engaging portion 43 do not interfere with each other, so that the assembly operation can be easily performed. Although, when the reeling core 23 is driven, the sliding contact member 35 rotates along with the rotation of the spool 22*b*, one of the to-be-engaged portions 44 engages with the engaging portion 43 by the rotation of 90 degrees or less because there are four to-be-engaged portions 44, and a braking force of the brake 3 is applied. Thereby, after the completion of the assembly of the tape cartridge 2, when a reeling test (torque test) is performed by driving the reeling core 23, useless reeling of the ink ribbon 22*a* can be prevented, and it also results in shortening the test time.

To prevent the sliding contact member 35 from rotating along with the spool 22*b*, at least one to-be-engaged portion 44 needs to be provided, and to cause the to-be-engaged portions 44 to perform positioning of the coil spring 36, at least three to-be-engaged portions 44 need to be provided.

According to the configuration described above, it is possible to prevent the sliding contact member 35 from rotating along with the spool 22*b*, appropriately maintain the sliding contact state of the sliding contact member 35 with respect to the spool 22*b*, and feed the ink ribbon 22*a* while providing stable back tension to the fed ink ribbon 22*a*. Needless to say, the brake 3 according to the present embodiment can be applied to various tape cartridges 2 (including ribbon cartridges) of various electronic devices that use a tape-shaped member.

REFERENCE SIGNS LIST

2 Tape cartridge
3 Brake
5 Assembly device
20 Cartridge case
20*a* Upper case
20*b* Lower case
22*a* Ink ribbon
22*b* Spool
30 Cylindrical shaft portion
35 Sliding contact member
36 Coil spring
37 Rotation restrictor
42 Flange portion
42*a* Sliding portion
43 Engaging portion
44 To-be-engaged portion

The invention claimed is:

1. A tape cartridge comprising:

a spool which is formed in a cylindrical shape and in which a tape-shaped member is wound around an outer circumference of the spool;

a case rotatably accommodating the spool; and a brake for providing back tension to the tape-shaped member unwound from the spool, wherein the brake includes a sliding contact member which is formed in a cylindrical shape having a bottom and is in sliding contact with an end surface of the rotating spool, an urging member which is provided inside the sliding contact member and urges the sliding contact member in a shaft direction of the spool from the case, the sliding contact member including a to-be-engaged portion which protrudes from an inner circumference of the sliding contact member; and a rotation restrictor for restricting rotation of the sliding contact member, and the rotation restrictor includes an engaging portion protruding from the case to be inserted into the sliding contact member, a terminal end of the rotation restrictor engaging an end of the urging member, and wherein, the to-be-engaged portion, which protrudes from an inner circumference of the sliding contact member, is configured to engage with the engaging portion in a rotation direction of the spool.

2. The tape cartridge according to claim 1, wherein the sliding contact member has a sliding portion in sliding contact with an end surface of the rotating spool, and the sliding portion is formed in a cross-sectional half circle shape.

3. The tape cartridge according to claim 1, wherein a plurality of the to-be-engaged portions are protruded from the inner circumference of the sliding contact member in a circumferential direction at regular intervals.

4. The tape cartridge according to claim 3, wherein the urging member has a coil spring inserted into the sliding contact member, three or more to-be-engaged portions are protruded from the inner circumference of the sliding contact member, and the three or more to-be-engaged portions also function as positioning members of the coil spring in the sliding contact member.

5. The tape cartridge according to claim 4, wherein a cylindrical urging-force-receiving portion protruding toward the sliding contact member is formed to be a reception portion of the coil spring inserted into the sliding contact member, and the engaging portion is formed to be protruded to the outside in a radial direction at a base end portion of the urging-force-receiving portion.

6. The tape cartridge according to claim 5, wherein the coil spring is contained in the sliding contact member when the coil spring is accommodated in a free state.

* * * * *